US006282872B1

(12) United States Patent
Schulte

(10) Patent No.: US 6,282,872 B1
(45) Date of Patent: Sep. 4, 2001

(54) SAFETY MOUNTING ASSIST STIRRUP

(76) Inventor: Frank Schulte, Country Rd., 357 Box 47, Mayo, FL (US) 32066

( * ) Notice: Subject to any disclaimer, the term of this patent is extended or adjusted under 35 U.S.C. 154(b) by 0 days.

(21) Appl. No.: 09/489,053

(22) Filed: Jan. 21, 2000

(51) Int. Cl.[7] ..... B68C 3/02
(52) U.S. Cl. ..... 54/49
(58) Field of Search ..... 54/47, 49

(56) References Cited

U.S. PATENT DOCUMENTS

| | | |
|---|---|---|
| 0,932,886 | 8/1909 | McClure . |
| 1,079,801 | 11/1913 | Sarrett et al. . |
| 1,087,503 | 2/1914 | Neidigh . |
| 1,088,552 | 2/1914 | Dolan et al. . |
| 1,186,651 | 6/1916 | Douthitt et al. . |
| 1,480,314 | 1/1924 | Szymanski . |
| 4,587,798 | 5/1986 | Taylor . |
| 5,809,754 | 9/1998 | Schulte . |
| 5,826,413 | 10/1998 | Bostock et al. . |

FOREIGN PATENT DOCUMENTS

| | | | | |
|---|---|---|---|---|
| 32862 | * | 5/1908 | (AT) | 54/49 |
| 14094 | * | 6/1909 | (GB) | 54/47 |
| 2183437 | * | 6/1987 | (GB) | 54/49 |

* cited by examiner

*Primary Examiner*—Robert P. Swiatek
(74) *Attorney, Agent, or Firm*—Dowell & Dowell, P.C.

(57) ABSTRACT

An assist step for a stirrup associated with a saddle wherein the step is secured to or formed integrally with an outer side element of the stirrup which is pivotally mounted at a base of the stirrup such that when pivoted downwardly relative to the base, the step provides a platform for assisting a rider in mounting a saddle. The outer side element also functions as a safety breakaway portion for the stirrup to permit release of a rider's foot in the event a rider falls from the saddle.

14 Claims, 4 Drawing Sheets

31
A
42
36
40
60
38A
38
35
5
5
48
38B
39
30
34
A 31
42
38
48
34

42
70
36
35
10
10
48
38B
30
34
39
38A
60
38

42
70
36
35
48
34
38
38A
60

Fig. 5
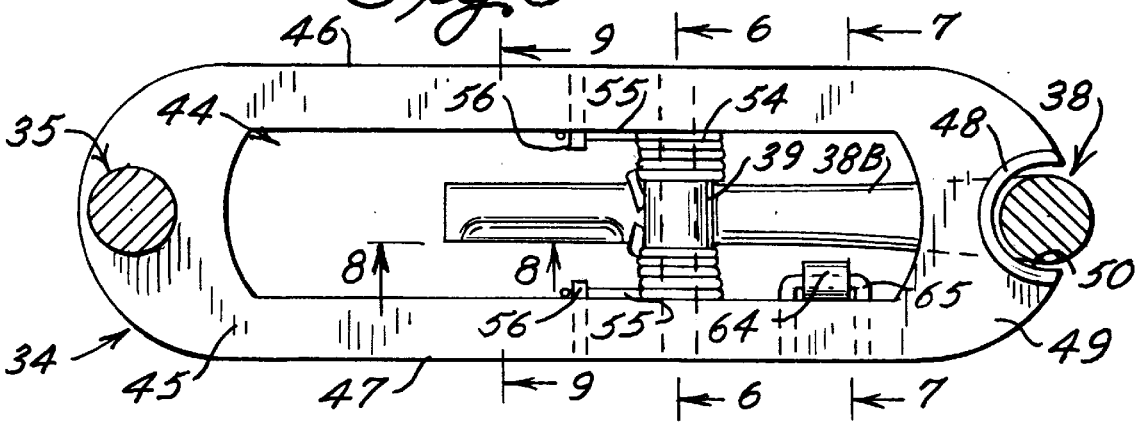
Fig. 6
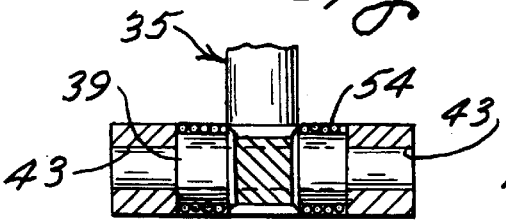
Fig. 7
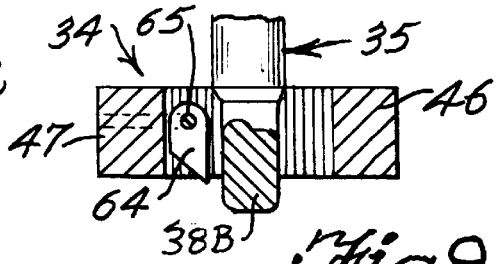
Fig. 8
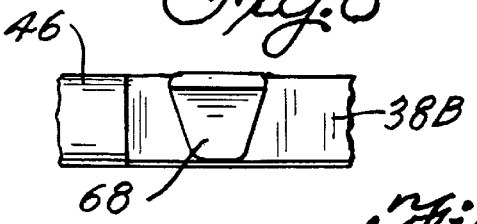
Fig. 9
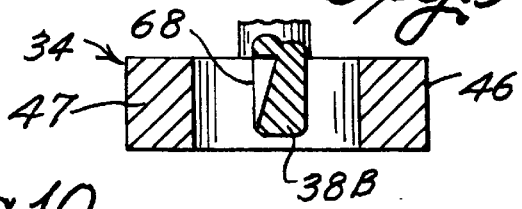
Fig. 10
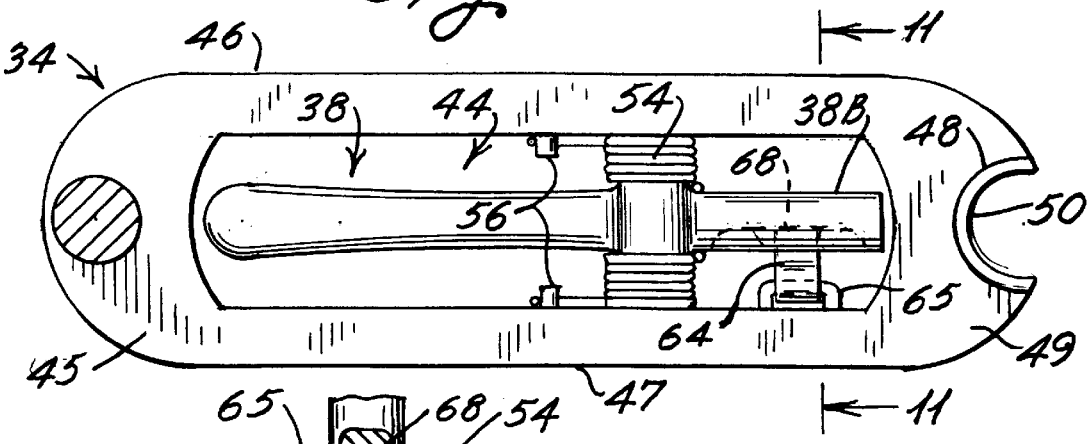
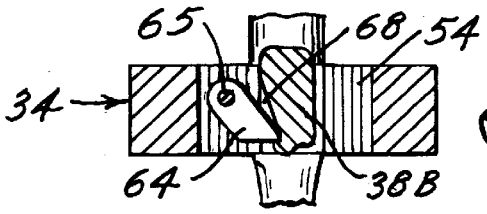
Fig. 11

Fig. 18
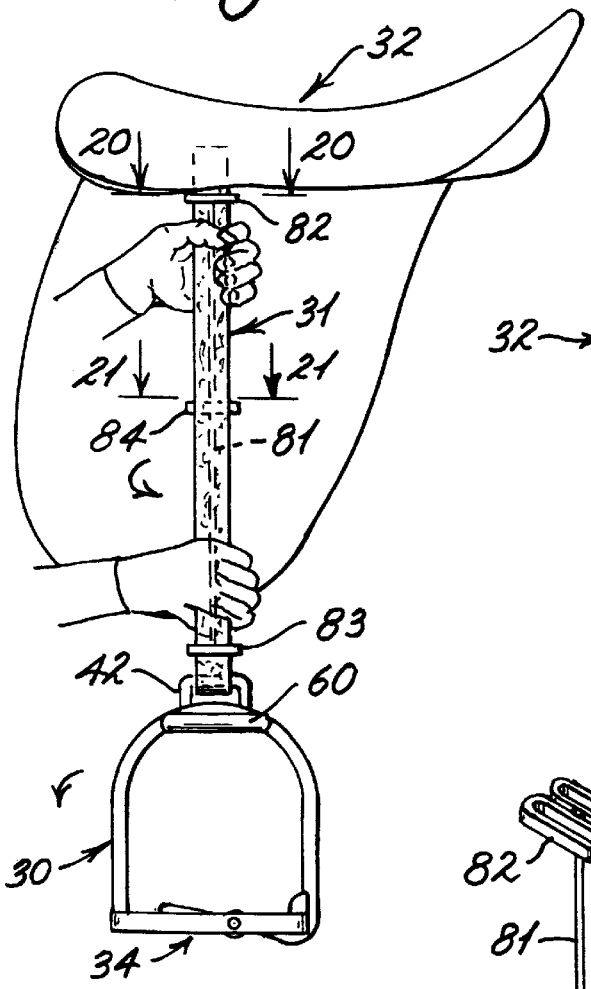
Fig. 19
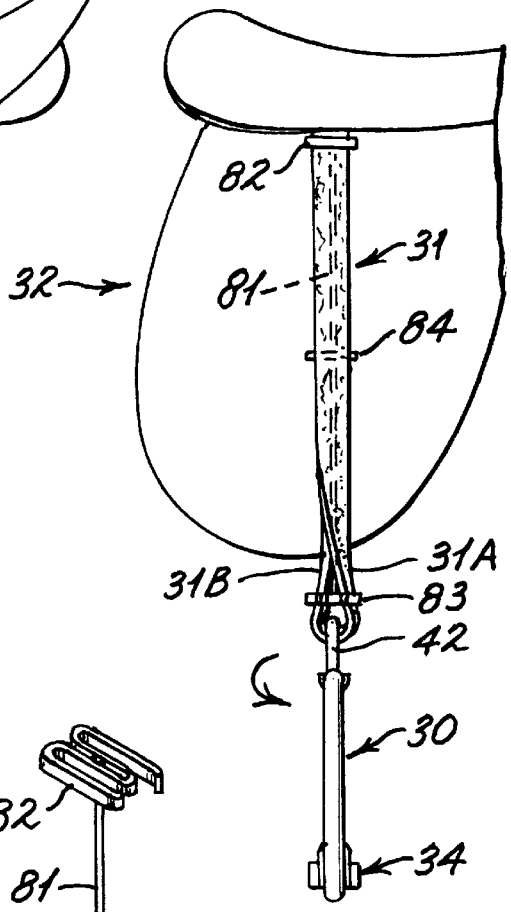
Fig. 20
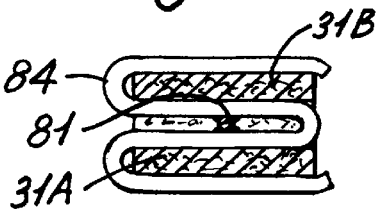
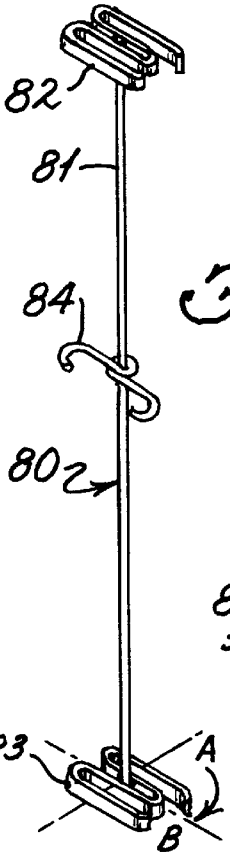
Fig. 22
Fig. 21
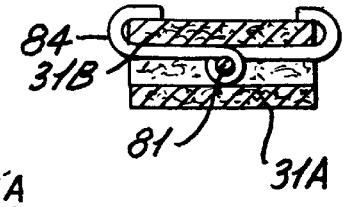
Fig. 23
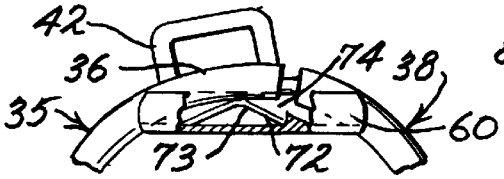

SAFETY MOUNTING ASSIST STIRRUP

BACKGROUND OF THE INVENTION

1. Field of the Invention

The present invention is generally directed to improvements in saddlery and more particularly to a stirrup having a portion formed to pivot relative to a base so as to provide an auxiliary step when pivoted to a position below the base to thereby be accessible to assist a rider in mounting a saddle and which portion further functions as a safety device providing a breakaway portion for the stirrup to permit release of a rider's foot in the event the rider falls from the saddle, thus preventing possible serious injury.

2. History of the Related Art

Conventional stirrups used with saddles are generally designed to be adjustably supported at varying vertical relationships with respect to the saddles by stirrup leathers or straps. The straps include an adjusting mechanism, such as a buckle, which allow the straps to be vertically adjusted to suit individual riders so that the stirrup is conveniently positioned for being engaged by the riders foot not only when mounting a saddle, but while riding. In some instances, however, the stirrup strap is not sufficiently adjustable to permit the stirrup to be easily accessible, especially if the mount is a large horse or the rider is an individual who cannot easily place their foot within the stirrup for purposes of mounting.

In this respect, in applicant's previous U.S. Pat. 5,809,754, an auxiliary step for a stirrup is disclosed wherein the step is pivotable relative to the base of the stirrup to provide a platform deposed below the stirrup for use in facilitating mounting. Once mounted, the auxiliary step is designed to automatically pivot upwardly so as not to obstruct the normal use of the stirrup.

A further problem often encountered with conventional stirrups is that a rider's foot may become caught or entangled within the stirrup in the event the rider falls from the saddle. Such entanglement of a rider's foot within a conventional stirrup can result in severe physical injury as the rider can be dragged for some distance.

In view of the foregoing, there remains a need to provide a stirrup which not only functions to provide an assist or auxiliary step for assisting a rider mounting a saddle but which also functions as a safety or breakaway stirrup to prevent rider injury by assuring that the rider's foot may be easily separated from the stirrup in the event of a fall. A number of patents have been directed to providing safety or breakaway stirrups, by way of example: U.S. Pat. No. 932,886 to McClure; U.S. Pat. No. 1,008,552 to Dolan et al.; U.S. Pat. No. 1,087,503 to Neidigh; U.S. Pat. No. 1,186,751 to Douthitt et al.; U.S. Pat. No. 1,480,314 to Szymanski; U.S. Pat. No. 4,587,798 to Taylor; and U.S. Pat. No. 5,826,413 to Bostock et al. Each of the disclosed safety stirrups has a portion designed to pivot relative to a base. In most of these patents, a side element is pivotally mounted to the remaining portion of the stirrup such that, if pressure is applied laterally relative to the base of the stirrup, an individual's foot will cause the pivotable portion of the stirrup to open thereby providing an opening through which a rider's foot may pass in the event of a fall. However, none of these patents provides a stirrup which can also be utilized as an assist step to facilitate mounting. In addition, there are features in the various prior art structures which are not desirable for the anticipated use as safety stirrups because the elements which are pivoting to allow an opening in the stirrup may themselves become obstructions thus possibly resulting in rider injury even though a portion of the stirrup opens to potentially release a rider's foot.

In view of the foregoing, there remains a need to provide a safety stirrup having portions which pivot away in the event a rider should fall from a saddle thereby releasing the riders foot and which also provides an auxiliary assist step to facilitate mounting.

SUMMARY OF THE INVENTION

The present invention is directed to a safety breakaway and mounting assist stirrup which includes a base portion having an elongated opening formed therein in which a base portion of an outer side element of the stirrup is pivotally mounted. The outer side element is mounted about a pivot shaft and include a main body which extends upwardly to form an outer side of the stirrup. A step is secured to or integrally formed to an outer end of the main body of the outer side element such that the step extends generally horizontally with respect to the base of the stirrup when the outer side element is pivoted to a position such that the step is disposed below the base of the stirrup. In this position, the step may be used to facilitate mounting. In the preferred embodiment, a free end of the step is somewhat bifurcated so as to facilitate closure of the step with a free end of an inner fixed side of the stirrup to thereby form a top portion of the stirrup when the outer side element is pivoted to an upper raised position. The inner side element of the stirrup is fixed with respect to the base and extends upwardly to an outer free end portion which is engagable with the outer free end portion forming the step of the pivotal side element of the stirrup.

The invention further provides a spring or other resilent element for normally urging the pivotable outer side element of the stirrup into the raised position and a latch member for maintaining the outer side element in the lowered position to provide an assist step. The latch member is preferably formed by a pivotable catch or pawl which is mounted so as to extend inwardly by gravity from one of the opposing walls of the stirrup base on either side of the opening formed in the base. The pawl is engaged within the notch by tilting the stirrup after the outer side element has been pivoted to lower the step into a lower deployed position. The pawl is retained in position to lock the step in the deployed position by the force of the spring urging the outer side element toward its raised position. When a rider engages the step to mount the saddle, the outer side element will pivot slightly beyond its deployed and locked position thereby releasing the pawl which will fall by gravity from engagement within the notch thereby allowing the outer side element to be pivoted to the raised position by the spring.

In the preferred embodiment, an outer end portion of the base of the stirrup includes a C-shaped opening for receiving a portion of the outer pivotable side element when the outer side element is pivoted to the closed or raised position.

The stirrup further includes a mounting element which is connected to an upper portion of the inner side element of the stirrup so as to be slightly off-centered toward the inside of the stirrup to thereby facilitate the manner in which the stirrup hangs relative to the saddle. The mounting element is designed to be secured to a conventional stirrup strap associated with the saddle. The positioning of the mounting element of the stirrup slightly off center causes the stirrup to tilt somewhat outwardly toward the outer side element to facilitate the opening of the stirrup in the event a rider falls from the saddle.

In other embodiments of the invention, a further spring locking element may be provided between the free ends of the fixed and pivotal side elements of the stirrup which will provide resistance to prevent premature opening or pivoting of the pivotable side element during the normal use of the stirrup.

This spring locking element will yield, however, to allow the opening of the outer side element in the event a rider's foot applies sufficient pressure to the outer side element, such as when a rider falls.

To further control the orientation of the stirrup of the present invention, a torsion device is secured within opposing segments of the stirrup strap. The torsion element includes upper and lower clamps that engaged with the strap and an elongated torsion rod which may be manually twisted. By applying a predetermined twist to the torsion rod, the stirrup can be positively retained generally perpendicularly outwardly relative to the elongated axis of the stirrup strap to thereby facilitate the placement of a rider's foot within the stirrup before and after mounting.

It is primary object to the present invention to provide a safety stirrup of the type having a pivotable or breakaway outer side element which is normally urged to a closed position relative to a fixed or inner side element but which will pivot away to allow a rider's foot to be released from the stirrup in the event sufficient pressure is applied, such as when a rider falls from a saddle, thereby preventing a rider's foot from becoming entangled in the stirrup.

It is also an object to the present invention to provide a stirrup including a device for assisting a rider in mounting a saddle wherein the assist device includes a step which is pivotable to extend below and generally parallel to a base of the stirrup and which is raised automatically by spring force when the step is disengaged after the rider has mounted.

It is yet another object to the present invention to provide a safety stirrup which includes a mounting element which is off center with respect to a center line of the stirrup so as to cause the stirrup to pitch somewhat outwardly to thereby facilitate the opening of an outer side element of the stirrup in the event a rider falls from a saddle.

It is another object of the present invention to provide a torsion element to facilitate the orientation or alignment of a stirrup with respect to a conventional saddle to insure maximum access to the opening in the stirrup.

BRIEF DESCRIPTION OF THE DRAWINGS

A better understanding of the invention will be had with reference to the attached drawing figures, wherein:

FIG. 5 is an enlarged cross sectional view taken along line 5—5 of FIG. 1;

FIG. 6 is an enlarged partial cross sectional view taken along line 6—6 of FIG. 5;

FIG. 7 is an enlarged cross sectional view taken along line 7—7 of FIG. 5;

FIG. 8 is a partial cross sectional view taken along line 8—8 of FIG. 5;

FIG. 9 is a partial cross sectional view taken along line 9—9 of FIG. 5;

FIG. 10 is a top plan view taken along line 10—10 of FIG. 3;

FIG. 11 is a cross sectional view taken along line 11—11 of FIG. 10 showing a catch for retaining the assist step in the lowered position shown in FIG. 3;

FIG. 18 is an illustrational view showing the stirrup of the present invention secured to a saddle strap with the torsion element being mounted between the front and rear segments of the strap;

FIG. 19 is a view similar to FIG. 18 showing a reorientation of the stirrup caused by an applied torsion to an elongated rod of the torsion element of FIG. 18;

FIG. 20 is an enlarged cross sectional view taken along line 20—20 of FIG. 18;

FIG. 21 is an enlarged cross sectional view taken along line 21—21 of FIG. 18;

FIG. 22 is a perspective view of a torsion element utilized with the stirrup of the present invention to orient the stirrup in a proper position relative to a saddle; and FIG. 23 is a partial view, on a reduced scale, of a retention device used with the present invention.

DESCRIPTION OF THE PREFERRED EMBODIMENT

Figure 15:
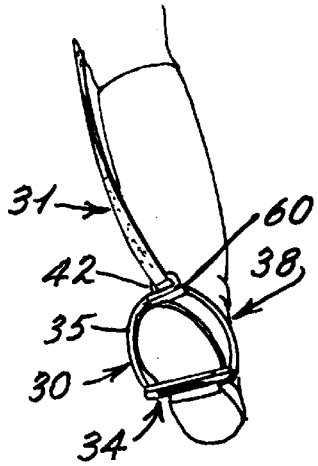
FIG. 15 is a view similar to FIG. 14 showing the orientation of the pivotable section of the stirrup relative to the outside of the rider's foot when a rider is mounted.
Figure 16:
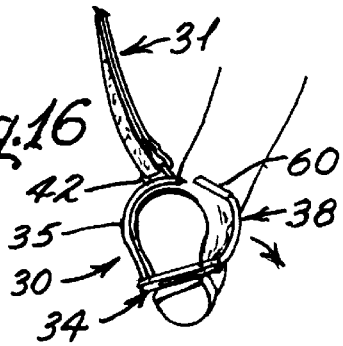
FIG. 16 is a view similar to FIG. 15 showing the opening of the pivotable outer element of the stirrup caused by a rider's foot applying pressure thereto when a rider falls from a saddle.

With particular reference to FIGS. 12–20, the assist step and safety stirrup 30 is shown as being carried by a conventional mounting strap or leather 31 associated with a saddle 32 which may be either of an English or Western style. The mounting strap is designed to be vertically adjustable, however, the strap is normally adjusted so that the stirrup is at an appropriate height relative to the saddle to be engaged by the foot of a rider when mounted on the saddle. Because of this, the stirrup is often somewhat elevated relative to the rider before mounting, making it difficult for the rider to position their foot in the stirrup to mount the saddle. The present invention is designed to provide an assist step which functions as a mounting aide by providing a foot engaging portion which is positioned below the normal base of the stirrup when the rider mounts, thus facilitating the mounting but allowing the stirrup to remain in an appropriately adjusted height for proper engagement with the rider's foot when mounted, as shown in FIG. 15.

The stirrup 30 includes a foot engaging base 34 from which extends an inner fixed side element 35 which terminates in an upper arcuate free end 36. An outer side element 38 of the stirrup is pivotally mounted by an integral pivot shaft 39 to the base 34 and includes an upper end 40. The stirrup is attached to the mounting strap 31 associated with the saddle by way of a mounting loop 42 which is integrally formed or securely welded or otherwise attached to an upper portion and adjacent the free end 36 of the inside element 35 of the stirrup. It should be noted that the mounting loop 42 is somewhat off center relative to a central axis "A—A" of the stirrup. This off centered positioning relative to the mounting strap of the saddle is designed to aide in creating a pitch or angle to the stirrup when in use, such that the stirrup tilts outwardly away from a mount to facilitate a safety feature of the stirrup which includes the pivotal outer side element 38, as will be described in greater detail hereinafter.

Figure 1:
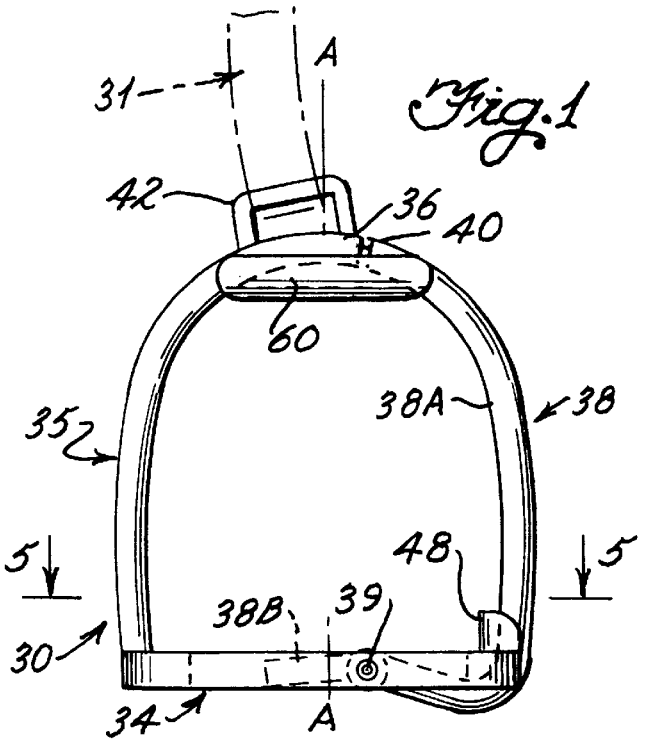
FIG. 1 is a front elevational view of a stirrup incorporating the elements of the present invention.
Figure 2:
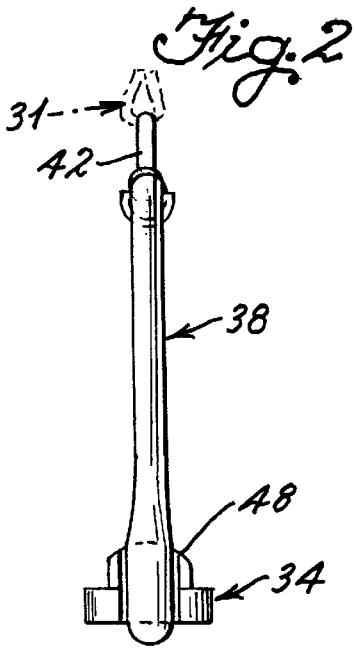
FIG. 2 is a view taken from the left side of the stirrup of FIG. 1.

During normal use, when a rider is mounted on a saddle as shown by example in FIG. 15, the stirrup 30 is in a configuration shown in FIG. 1 with the pivotable outer side element 38 in a raised position. With particular reference to FIGS. 5–11, the manner in which the outer side element is pivoted and retained in both a lowered step assist position and a raised position is disclosed. As shown in FIG. 5, the base 34 of the stirrup includes an enlarged opening 44. An upper foot rest portion 45 of the base is defined by a pair of spaced base segments 46 and 47 and an upwardly extending generally semicircular flange 48 which is provided along an outer portion 49 of the base. As shown, the base includes a U-shaped notch 50 which receives the outer side element 38 of the stirrup when the outer side element is in the raised position of FIG. 1. The flange 48 is designed to provide a stop to prevent shifting movement of a rider's foot when the foot is engaged against the upper surface 45 of the base and thus prevents inadvertent opening of the outer side element 38 about a pivot axis defined by the shaft 39.

The pivot shaft 39 has outer ends which are seated within openings 43 in each of the opposing side walls of the base elements 46 and 47. The outer side element not only includes a vertical body portion 38A but a horizontal base portion 38B.

When the stirrup is in the closed position shown in FIG. 1, the base portion 38B is shown as being generally received between or extending below the elements 46 and 47 of the base 34 so as not to protrude into the opening 48 defined by the stirrup. The outer side element is normally retained in the raised position shown in FIG. 1 by a torsion spring 54 which is mounted about the outer end portions of the pivot shaft 39. The free ends 55 of the coil spring abut pins 56 extending inwardly from the spaced elements 46 and 47 of the base 34. The spring is designed to provide sufficient force to normally urge the outer side element 38 into a raised position and to resist an easy pivotable motion of the side element 38 about the axis defined by the pivot shaft 39.

The outer side element 38 of the stirrup also includes a step portion 60. The step portion 60 is shown as being horizontally oriented when the outer side element is either in the raised position shown in FIG. 1 or a deployed mounting or lower position shown in FIG. 3. The step may be integral with the vertical portion 38A of the outer side element or may be welded thereto. In the embodiment shown in the drawing figures, the step is formed of a somewhat V-shaped element which is welded at one end 61 adjacent the end 40 of the outer side element 38 with the generally free opposite end portion 62 thereof being defined by somewhat bifurcated sections which permit the step to engage on opposite sides of the upper free end of the inner side element 35. In this manner, the outer end portion 62 of the step 60 serves as an alignment device as the outer element pivots to the raised position as shown in FIG. 1 relative to the free end 36 of the inner side element 35.

Figure 3:
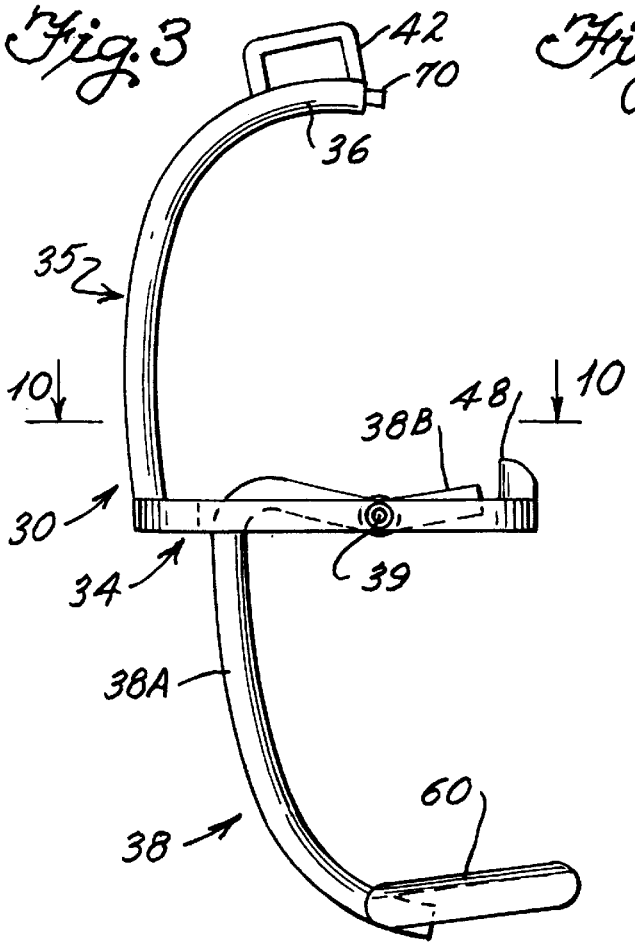
FIG. 3 is a front perspective view of the stirrup of FIG. 1 showing the outer portion of the stirrup pivoted downwardly to a position to function as an assist step.

When it is desired to use the assist step 60 associated with the outer pivotable side element 38, the outer side element is pivoted such that the step 60 is lowered and inverted to the position shown in FIG. 3. In this position, the rider may utilize the step 60 to assist in mounting the saddle by placing a foot on the step 60 and thereafter mounting the saddle. It should be noted that the length of the step 60 may be increased as desired so that the step may be substantially wider than as shown in the drawing figures but yet not interfere with the normal use of the stirrup when the stirrup is in the configuration shown in FIG. 1.

To lock the step 60 in the lower position shown in FIG. 3, the present invention provides a catch or pawl 64 which is pivoted about a shaft 65 having opposite ends mounted to the element 47 of the base 34 of the stirrup, as is shown in FIGS. 5 and 10. A tapered notch 68 is formed in a lateral side wall adjacent a free end of the base portion 38B of the outer side element 38. The notch defines an engagement or abutment surface 69 against which the free end of the pawl 64 is engageable, as shown in FIG. 11, when the step 60 is pivoted to the lower position. As the step is lowered, the stirrup is tilted slightly to allow the pawl to pivot by gravity into engagement with the notch. In this position, the torsion spring will force the abutment surface 69 against the pawl thereby preventing rotation of the side element 38 and the pivot shaft 39 until the pawl or catch is released from engagement within the notch 68. When the rider mounts the saddle, the pressure of the rider's foot against the step will cause a further slight pivoting motion about this pivot shaft 39. This motion of the side element is clockwise relative to the position shown in FIG. 3 by a short distance. This distance is enough to free the pawl from engagement within the notch 68 thus allowing the pawl to fall by gravity away from the base element 38B and allowing the outer side element 38 to pivot due to the force of the spring 54 to the raised position shown in FIG. 1 as soon as the rider's foot is released from the step.

Figure 4:
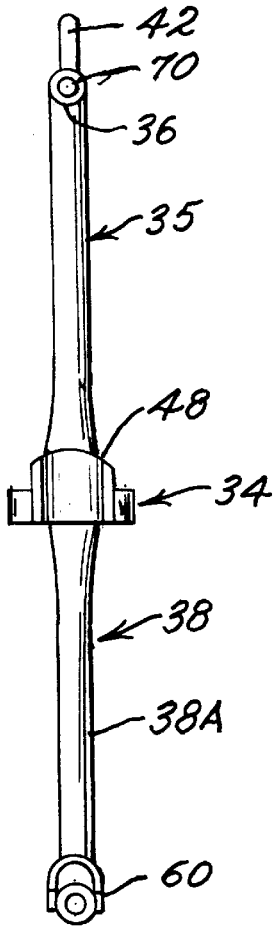
FIG. 4 is a view taken from the left side of the stirrup as shown in FIG. 3.
Figure 12:
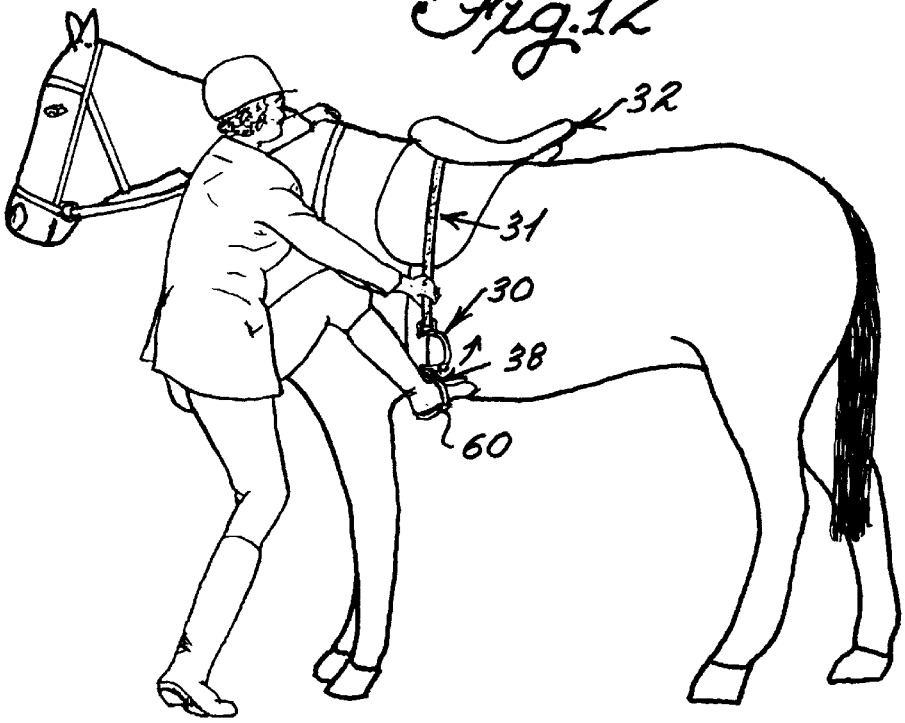
FIG. 12 is a perspective illustrational view of the stirrup of the present invention showing the assist step in the lower position to assist a rider in mounting a saddle.
Figure 13:
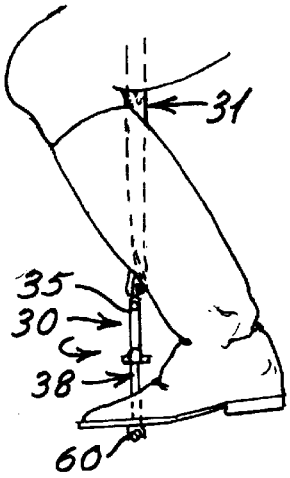
FIG. 13 is an illustrational view showing the stirrup assist step being used for mounting.
Figure 14:
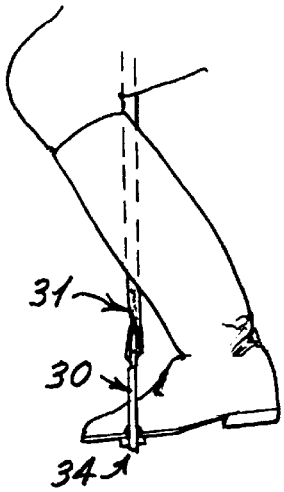
FIG. 14 is a view similar to FIG. 13 except showing the stirrup in a closed position after a rider has mounted.

With specific reference to FIG. 3 and 4, the free end 36 of the inner fixed side element 35 may include an abutment member 70 which extends therefrom which may be formed of a hard rubber material which cushions the impact of the end 40 of the pivotable outer side element 38 when being urged by the torsion spring to the closed position of FIG. 1.

With particular reference to FIG. 23, an alternate embodiment of the present invention is shown which includes a leaf spring 72 which is mounted within the "U" or "V" shaped surface portion of the step 60. The leaf spring includes a projection 73 which is normally engageable with a projection 74 extending downwardly from the free end 36 of the fixed side element 35. The leaf spring generally opposes the opening of the pivotable side element 38, however, the force of the leaf spring may be overcome in the event a rider is thrown from the saddle. Therefore, when the rider's foot engages the pivotable element 38, it will cause the leaf spring to disengage allowing pivotable motion about the pivot shaft 39 and against the torsion spring.

Figure 17:
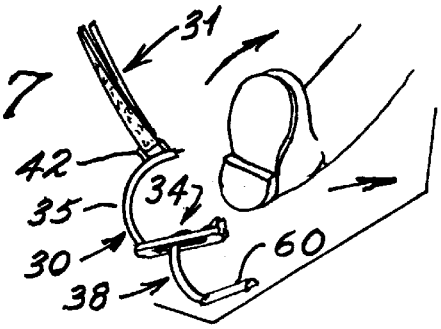
FIG. 17 is a view similar to FIG. 16 showing the stirrup in a fully opened position to release a rider's foot in the event a rider falls.

The present invention is specifically designed not only to provide an assist step for use with the stirrup, but also to provide a safety device in the form of a pivotable outer side element which will yield and give way in the event a rider falls from a saddle. With specific reference to FIGS. 16 and 17, in the event a rider is thrown from the saddle, the motion of the rider away from the mount will cause a movement of the rider's foot outwardly relative to the stirrup 34. When the rider's foot engages the pivotable side element 38, the stirrup will open against the torsion spring 34 and, when provided, the leaf spring 72, to allow an opening of the side element to a position wherein the rider's foot is freely released, as is shown in FIG. 17. This action prevents the rider's foot from being entangled which can result in severe bodily injury.

With specific reference to FIG. 19–22, the orientation of the stirrup of the invention may also be selectively controlled utilizing a torsion element 80 which is designed to be secured to the stirrup strap 31 of the saddle 32. The torsion element includes an elongated torsion rod 81 having an upper double hook or slide clamp 82 which is engageable about opposing segments 31A and 31B forming the strap 31 and a lower double hook or clamp element 83 also engageable with the opposing segments 31A and 31B of the stirrup strap. In some embodiments, an intermediate clamp 84 may be provided for engaging about the strap as shown in FIGS. 19 and 20. Once the segments 31A and 31B of the stirrup strap 31 have been seated within the jaws of the upper and lower clamps 82 and 83, as shown in FIG. 21, the orientation of the stirrup 30 may be varied by placing a rotational twist on the torsion rod 81. It is normally desired to have the stirrup orientated such that the plane of the opening in the stirrup is generally perpendicular to the mount such that the stirrup extends generally perpendicular outwardly relative to the saddle. This orientation makes the stirrup step accessible to the rider when mounting and also makes it easier for the rider to position their foot within the opening of the stirrup after mounting. The torsion rod 81 is a metallic material which permits a predetermined amount of torsional force to be developed by twisting the rod as illustrated in FIG. 19.

In the use of the stirrup of the present invention, in a preferred embodiment, the torsion element 80 is placed within the strap segments 31A and 31B of the stirrup strap 31 and thereafter the stirrup is oriented to the position shown in FIG. 20 of the drawings wherein the clamp 83 is twisted from an axis "A" in FIG. 18 to an axis "B". Thereafter, the step which forms part of the outer side element of the stirrup is pivoted to the lower position shown in FIG. 3 and is locked utilizing the pawl arrangement as previously discussed. The rider thereafter places the appropriate foot on the step and mounts the saddle. After mounting, the rider releases his or her foot from the step thus allowing the side element to be pivoted by the torsion spring to the fully closed position shown in FIG. 1. The rider may thereafter place a foot on the surface of the base of the stirrup with the outer flange of the base preventing premature opening of the pivotable side element by engaging the foot of the rider.

In the event a rider is thrown, the rider's foot will urge the pivotable side element to the open position thereby freeing the rider's foot and preventing entanglement which can lead to severe bodily injury.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A stirrup for use for with a saddle and adapted to be mounted to a mounting strap, the stirrup comprising, a foot engageable base having an inner end and an outer end, an inner side element connected to and extending upwardly from said inner end of said base to an upper free end, an outer side element having a lower portion and an upper portion, means for pivotally mounting said lower portion of said outer side element to said base such that said upper portion is moveable between a raised position in opposing relationship with said free end of said inner side element to a lower position spaced below said base and extending generally parallel thereto, said upper portion including a foot engaging step for assisting mounting when in said lower position, resilient means for normal urging said outer side element to said raised position to thereby close the stirrup but allowing said outer side element to pivot toward said lower position against the force thereof, and means for releasably retaining said outer side element in said lower position.

2. The stirrup of claim 1 in which said base includes an upwardly extending flange adjacent said outer end thereof, said flange including an upper end terminating in spaced relationship with respect to said base.

3. The stirrup of claim 2 in which said outer end of said base includes a concave recess for selectively receiving a portion of said outer side element when said outer side element is in said raised position.

4. The stirrup of claim 3 in which said base includes an opening therein in which said lower portion of said outer side element is pivotally mounted, and said means for normally urging including a spring means mounted intermediate said base and said lower position of said outer side element for normally urging said outer side element toward said raised position.

5. The stirrup of claim 4 in which said means for releasably retaining said outer side element in said lower position includes a pawl member pivotally mounted to said base, a notch formed in said lower portion of said outer side element in which said pawl is selectively received when said outer side element is in said lower position.

6. The stirrup of claim 5 including a mounting element mounted to said inner side element adjacent said upper free end thereof, said mounting element being orientated off-centered with respect to a central axis of the stirrup.

7. The stirrup of claim 5 including means extending from said free end of said inner side element for absorbing a force of engagement of said upper portion of said outer side element when said outer side element is moved to said raised position.

8. The stirrup of claim 7 in which said step of said outer side element is bifurcated as to selectively engage said inner side element on substantially opposite sides thereof when in said raised position.

9. The stirrup of claim 1 including a torsion assembly including at least two clamp members mounted along a length of a torsion rod, said clamp members being adapted to be a selectively engageable with a stirrup strap such that the orientation of said stirrup mounting strap may be varied by placing a predetermined twist on said torsion rod.

10. The stirrup of claim 1 in which said means for releasably retaining said outer side element in said lower position includes a pawl member pivotally mounted to said base, a notch formed in said lower portion of said outer side element in which said pawl is selectively received when said outer side element is in said lower position.

11. The stirrup of claim 1 including a mounting element mounted to said inner side element adjacent said upper free end thereof, said mounting element being orientated off-centered with respect to a central axis of the stirrup.

12. The stirrup of claim 1 including means extending from said free end of said inner side element for absorbing a force of engagement of said upper portion of said outer side element when said outer side element is moved to said raised position.

13. The stirrup of claim 1 in which said step of said outer side element is bifurcated as to selectively engage said inner side element on substantially opposite sides thereof when in said raised position.

14. The stirrup of claim 1 in which said base includes an opening therein in which said lower portion of said outer side element is pivotally mounted, and said means for normally urging including a spring means mounted intermediate said base and said lower position of said outer side element for normally urging said outer side element toward said raised position.

* * * * *